US005997157A

United States Patent [19]

Chen

[11] Patent Number: 5,997,157

[45] Date of Patent: Dec. 7, 1999

[54] LAMP SHADE COMBINATION

[76] Inventor: Shu O Chen, No. 1697, Chong Hua Rd., Tou Fen Town, Miao Li Hsien, Taiwan

[21] Appl. No.: 08/959,552

[22] Filed: Oct. 28, 1997

[51] Int. Cl.[6] ..... F21V 11/00

[52] U.S. Cl. ..... 362/351; 362/354; 362/360; 362/217; 362/219; 362/225

[58] Field of Search ..... 362/351, 354, 362/360, 217, 219, 225

[56] References Cited

U.S. PATENT DOCUMENTS 2,569,772 10/1951 Olsen ..... 362/217

*Primary Examiner*—Thomas M. Sember
*Assistant Examiner*—John A. Ward

[57] ABSTRACT

A lamp shade includes a pair of brackets each having a number of orifices, and a number of rods having two ends engaged with the orifices of the brackets for allowing the rods to be secured between the brackets. The orifices are intersected with each other for forming a slot and for engaging with the ends of one or more plates. The brackets each includes a number of cavities communicating with the orifices and each having a square cross section for engaging with the ends of a number of beams and for allowing the beams to be secured between the brackets.

7 Claims, 5 Drawing Sheets

LAMP SHADE COMBINATION

BACKGROUND OF THE INVENTION

1. Field of the Invention

The present invention relates to a lamp shade, and more particularly to a lamp shade combination for lamps that are particularly used in bathroom.

2. Description of the Prior Art

Typical lamp shades for the lamps used in bathroom comprise a simple configuration for receiving the light bulb. The lamp shades may not be changed to different configurations.

The present invention has arisen to mitigate and/or obviate the afore-described disadvantages of the conventional lamp shades.

SUMMARY OF THE INVENTION

The primary objective of the present invention is to provide a lamp shade combination which may be assembled into various kinds of structure according to the user's need.

In accordance with one aspect of the invention, there is provided a lamp shade combination comprising a pair of brackets each including a number of orifices, and a number of rods each including two ends engaged with the orifices of the brackets for allowing the rods to be secured between the brackets.

The orifices of the brackets are intersected and communicating with each other for forming at least one slot, the lamp shade combination further includes at least one plate having two ends engaged in the slot of the bracket for allowing the plate to be secured between the brackets.

The brackets each includes an inner portion and an outer portion, the orifices are formed in the outer portion of the brackets, the brackets each further includes a number of cavities formed in the inner portion and communicating with the orifices, and a number of beams having two ends for engaging with the cavities and for allowing the beams to be secured between the brackets.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figures 1, 4:
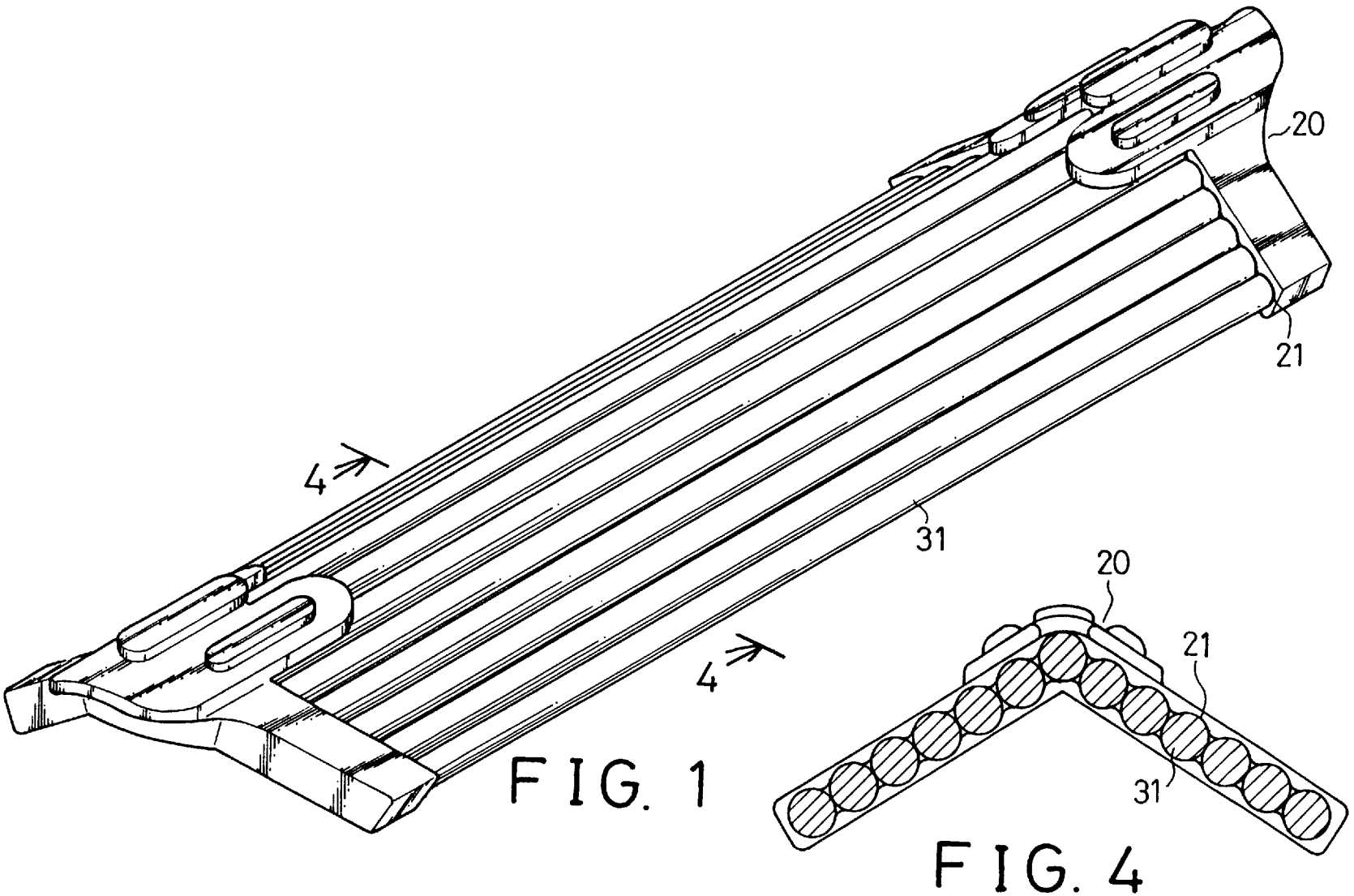
FIG. 1 is a perspective view of a lamp shade in accordance with the present invention.
FIG. 4 is a cross sectional view taken along lines 4—4 of FIG. 1.
Figure 2:
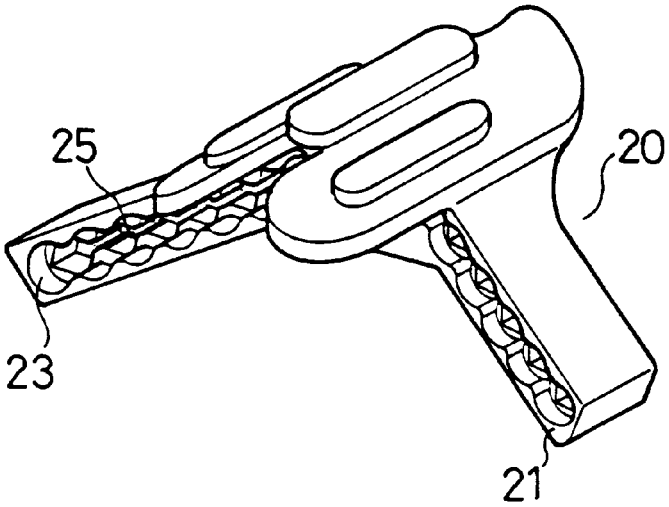
FIG. 2 is a perspective view of a bracket of the lamp shade.
Figure 3:
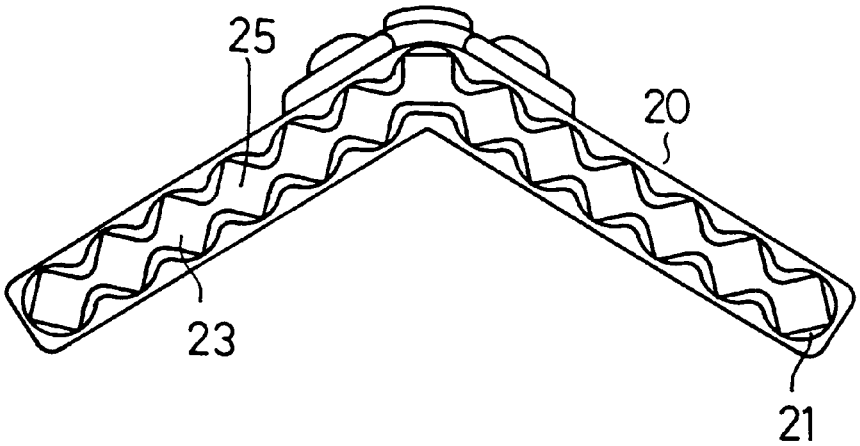
FIG. 3 is an end view of the bracket.

Referring to the drawings, and initially to FIGS. 1–4, a lamp shade combination in accordance with the present invention is provided for a lamp device, particularly a lamp device that is used in bathroom. The lamp device includes a base having a socket for engaging with one or more light bulbs and having a support for supporting the lamp shade combination on top of the base. The lamp shade combination comprises a pair of brackets 20 and a number of rods 31 secured between the brackets 20. The brackets 20 each includes a number of orifices 21 having circular cross section for engaging with the ends of the rods 31 which include a circular cross section. The orifices 21 are intersected and communicating with each other for forming a continuous slot 23. The brackets 20 each further includes a number of cavities 25 having a size smaller than that of the orifices 21 and having a square cross section, for example. The cavities 25 are formed in the deeper portion or inner portion of the brackets 20, and the orifices 21 are formed in the outer portion and communicating with the cavities 25.

Figures 5, 6:
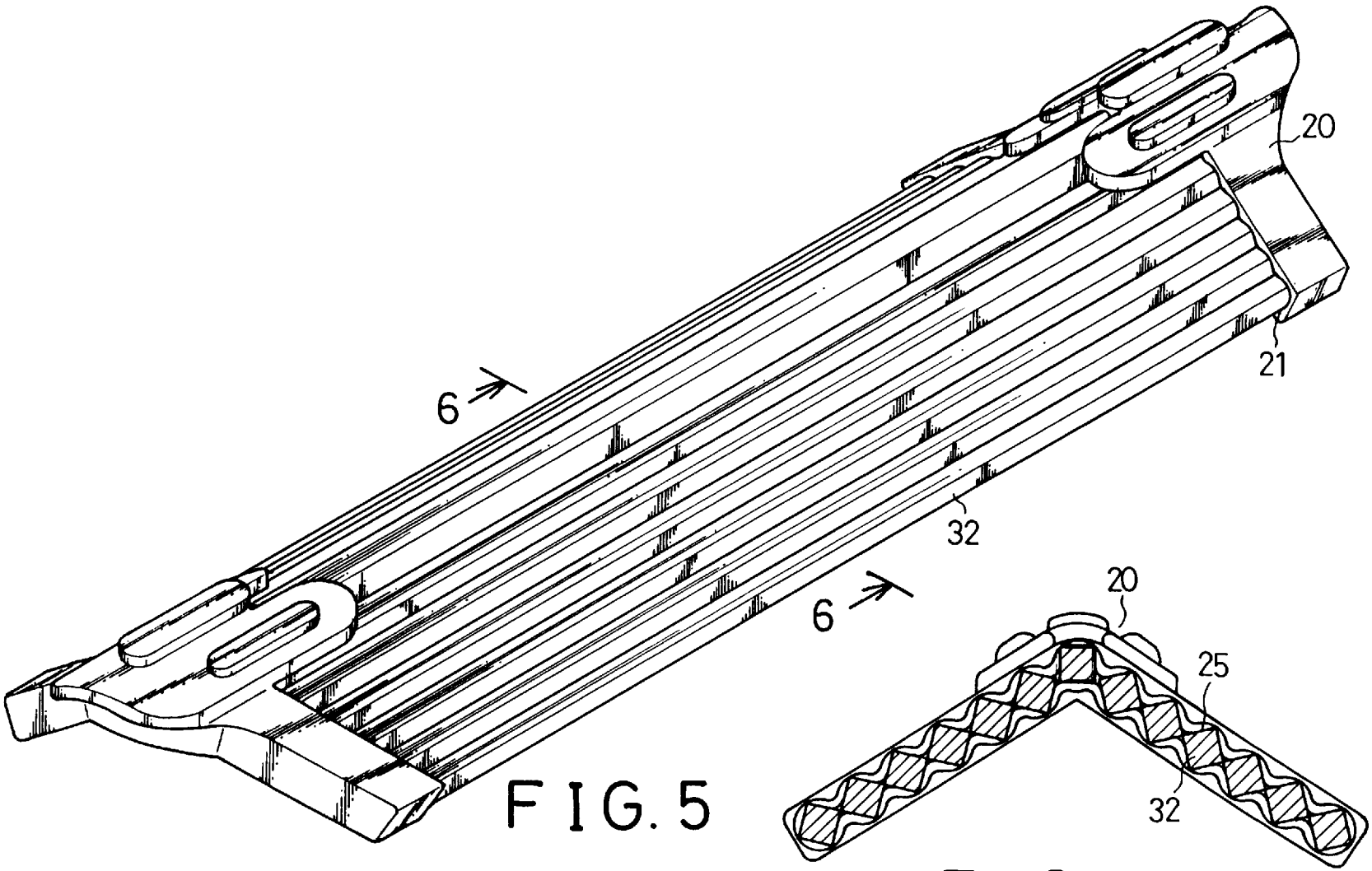
FIGS. 5, 7, 9 are perspective views illustrating three applications of the lamp shade combination.
FIGS. 6, 8, 10 are cross sectional views taken along lines 6—6 8—8 10—10 of FIGS. 5, 7, 9 respectively.
Figures 7, 8:
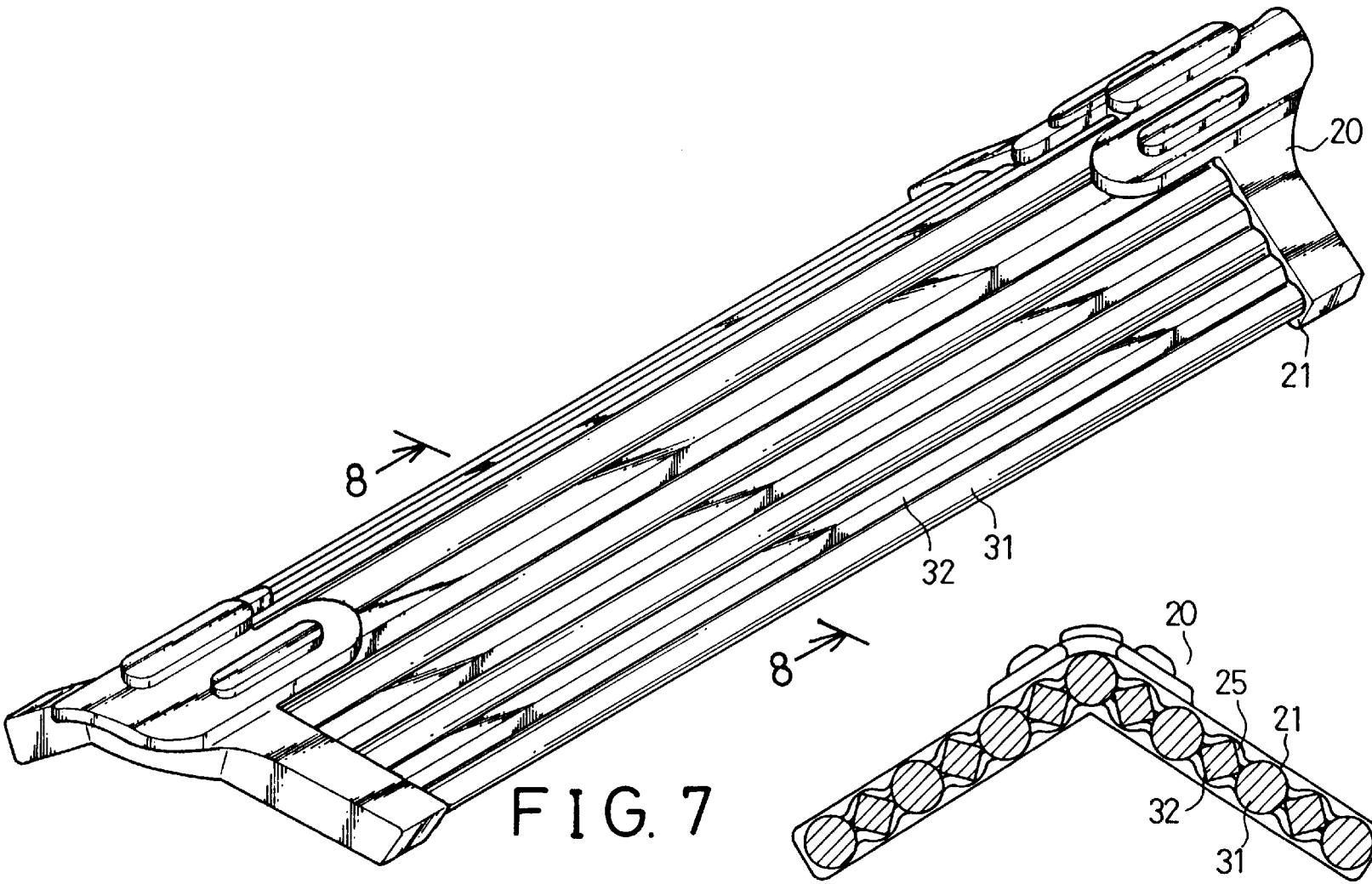
Figures 9, 10:
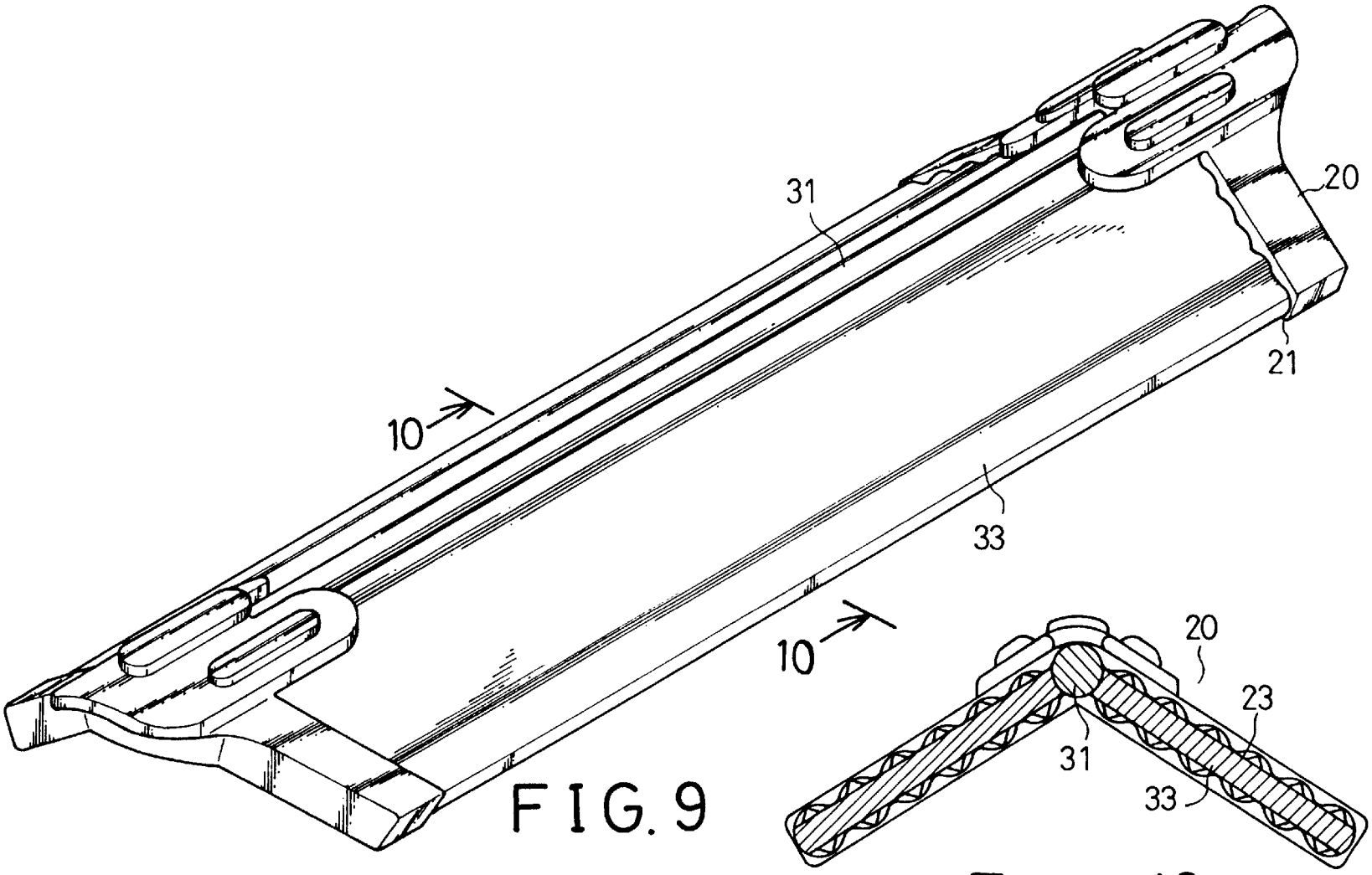

Referring next to FIGS. 5 and 6, the beams 32 of square cross section may engage their ends with the square cavities 25 for forming another type of lamp shade. Referring next to FIGS. 7 and 8, the rods 31 and the beams 32 may be engaged between the brackets 20 alternatively for forming a further structure. Referring next to FIGS. 9 and 10, one or more plates 33 may engage with the slots 23, and one or more rods 31 may be engaged between the brackets 20 for forming a still further structure.

It is to be noted that the brackets 20 include a specially designed configuration for allowing the rods 31 of circular cross section and the beams 32 of square cross section and the plates 33 to be easily secured between the brackets 20. The user may thus assemble the rods 31, the beams 32 and the plates 33 between the brackets 20 and may be assembled into various kinds of structure according to the user's need.

Accordingly, the lamp shade combination includes a pair of brackets which allows the rods 31, the beams 32 and the plates 33 to be assembled between the brackets 20 easily according to the user's requirement.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp shade combination comprising:

a pair of brackets each including a plurality of orifices, and a plurality of rods each including two ends engaged with said orifices of said brackets for allowing said rods to be secured between said brackets, said orifices of said brackets being intersected and communicating with each other for forming at least one slot, said lamp shade combination further including at least one plate having two ends engaged in said at least one slot of said bracket for allowing said at least one plate to be secured between said brackets.

2. A lamp shade combination comprising:

a pair of brackets each including a plurality of orifices, and a plurality of rods each including two ends engaged with said orifices of said brackets for allowing said rods to be secured between said brackets, said brackets each including an inner portion and an outer portion, said orifices being formed in said outer portion of said brackets, said brackets each further including a plurality of cavities formed in said inner portion and communicating with said orifices, and a plurality of beams having two ends for engaging with said cavities and for allowing said beams to be secured between said brackets.

3. A lamp shade combination comprising:

a pair of brackets each including a plurality of cavities, and a plurality of beams each including two ends engaged with said cavities of said brackets for allowing said beams to be secured between said brackets, said brackets each including an inner portion and an outer portion, said cavities being formed in said inner portion of said brackets, said brackets each further including a plurality of orifices formed in said outer portion and communicating with said cavities, and a plurality of rods having two ends for engaging with said orifices and for allowing said rods to be secured between said brackets.

4. A lamp shade combination comprising:

a pair of brackets each including a plurality of cavities, and a plurality of beams each including two ends engaged with said cavities of said brackets for allowing said beams to be secured between said brackets, said orifices of said brackets being intersected and communicating with each other for forming at least one slot, said lamp shade combination further including at least one plate having two ends engaged in said at least one slot of said bracket for allowing said at least one plate to be secured between said brackets.

5. A lamp shade combination comprising:

a pair of brackets each including at least one slot, and at least one plate including two ends engaged with said at least one slot of said brackets for allowing said at least one plate to be secured between said brackets.

6. The lamp shade combination according to claim 5, wherein said brackets each includes an inner portion and an outer portion, said brackets each includes a plurality of orifices formed in said outer portion and intersected and communicating with each other for forming said at least one slot and for engaging with said at least one plate, said lamp shade combination further includes a plurality of rods having two ends for engaging with said orifices and for allowing said rods to be secured between said brackets.

7. The lamp shade combination according to claim 5, wherein said brackets each includes a plurality of cavities formed in said inner portion and communicating with said orifices, and said lamp shade combination further includes a plurality of beams having two ends for engaging with said cavities and for allowing said beams to be secured between said brackets.

* * * * *